US008384312B2

(12) United States Patent
Tsai

(10) Patent No.: US 8,384,312 B2
(45) Date of Patent: Feb. 26, 2013

(54) POWER DISTRIBUTION SYSTEM FOR SUPPLYING ELECTRICAL POWER TO A PLURALITY OF LIGHTING UNITS

(75) Inventor: Wen-Kuei Tsai, Taipei (TW)

(73) Assignee: GE Investment Co., Ltd., Taipei (TW)

( * ) Notice: Subject to any disclaimer, the term of this patent is extended or adjusted under 35 U.S.C. 154(b) by 170 days.

(21) Appl. No.: 12/791,198

(22) Filed: Jun. 1, 2010

(65) Prior Publication Data

US 2010/0308752 A1 Dec. 9, 2010

(30) Foreign Application Priority Data

Jun. 3, 2009 (TW) ..... 98118427 A

(51) Int. Cl.
*H05B 37/00* (2006.01)

(52) U.S. Cl. ..... 315/312; 315/324; 315/325; 315/291; 315/209 R

(58) Field of Classification Search ..... 315/312–326; 340/310.11, 310.16, 310.17, 310.18
See application file for complete search history.

(56) References Cited

U.S. PATENT DOCUMENTS 5,471,119 A 11/1995 Ranganath et al.
5,838,116 A * 11/1998 Katyl et al. ..... 315/307
6,138,241 A * 10/2000 Eckel et al. ..... 713/300
6,400,103 B1 * 6/2002 Adamson ..... 315/292
6,867,558 B2 * 3/2005 Gaus et al. ..... 315/314
7,683,777 B2 * 3/2010 Macaluso et al. ..... 340/538
7,747,357 B2 * 6/2010 Murdoch ..... 700/295
2003/0222603 A1 12/2003 Mogilner et al.
2005/0248440 A1 11/2005 Stevens
2008/0074056 A1 3/2008 Shen
2008/0111498 A1 5/2008 Budike
2008/0157939 A1 7/2008 Sutardja

* cited by examiner

*Primary Examiner* — Tuyet Thi Vo
(74) *Attorney, Agent, or Firm* — Stout, Uxa, Buyan & Mullins, LLP

(57) ABSTRACT

A power distribution system for applying electric power to a plurality of lighting units is provided. The power distribution system includes at least one user interface having a first pairing setting unit, a plurality of second pairing setting units, and a power line. The user interface is electrically connected with a power source. Each of the second pairing setting units is electrically connected with one of the lighting units, respectively. The power line connected with the lighting units is electrically connected between the first pairing setting unit and the second pairing setting units. Each of the second pairing setting units is capable of receiving an electrical signal output by the first pairing setting unit and determining whether the lighting unit controlled thereby is turned on or not. Therefore, each of the second pairing setting units connected with the same power line can be controlled individually.

15 Claims, 13 Drawing Sheets

POWER DISTRIBUTION SYSTEM FOR SUPPLYING ELECTRICAL POWER TO A PLURALITY OF LIGHTING UNITS

FIELD OF THE DISCLOSURE

The present disclosure relates to a power distribution system, and in particular to a power distribution system that can be constructed and set easily.

BACKGROUND OF THE DISCLOSURE

A power distribution system is the downstream terminal of a power supply system and is closely related to the end users of electrical power. For general residences or office buildings, the setup of power distribution system is complicated and mistakes often occurs in the setup operation, which leads to re-doing of the setup operation and additional working hours are wasted. Since the working hours spent in setting up a power distribution system is directly related to the installation cost, the overall cost of setting up a power distribution system cannot be lowered if the operation complication for setting up the power distribution system cannot be simplified and the rate of incorrect setup be reduced. Further, a conventional power distribution system is often set up according to the preference of a user and once modification of power supply is to be done, a great expense of re-installing the system is needed. Apparently, the existing power distribution system provides almost no flexibility in modifying the system arrangement. Further, a constructor of an existing power distribution system must predict all potential problems in setting up the power distribution system in order to eliminate the potential risk of re-installing the system. Thus, it is desired to improve the conventional power distribution systems.

SUMMARY OF THE DISCLOSURE

The present disclosure aims to provide a power distribution system that is advantageous in easy installation and simple setting.

Thus, the present disclosure provides a power distribution system that is applicable to supply electrical power to a plurality of lighting unties and that comprises at least one user interface, which comprises a first pairing setting unit, a plurality of second pairing setting units, and a power line. The user interface is electrically connected with a power source. Each of the second pairing setting units is electrically connected with one of the lighting units, respectively. The power line is electrically connected with each of the lighting units and is electrically connected between the first pairing setting unit and the second pairing setting units. Each of the second pairing setting units receives an electrical signal output by the first pairing setting unit and, based on the electrical signal, determines whether to turn on the lighting unit controlled thereby or not, whereby each of the lighting units electrically connected to the power line can be individually controlled.

In an embodiment of the present disclosure, each of the lighting units comprises one or multiple light source modules.

In an embodiment of the present disclosure, each of the second pairing setting units is combined with one of the lighting units.

In an embodiment of the present disclosure, the first pairing setting unit comprises a first power line communication unit and a first controller in electrical connection with the first power line communication unit and each of the second pairing setting units comprises a second power line communication unit and a second controller in electrical connection with the second power line communication unit, wherein the first controller is applicable to set a signal transmission mode of the first power line communication unit, and the second controller is applicable to set a signal receipt mode of the second power line communication unit.

In an embodiment of the present disclosure, the user interface comprises a switch.

In an embodiment of the present disclosure, the power distribution system further comprises a central control unit in electrical connection with the power line, wherein the central control unit comprises a third pairing setting unit, which is electrically connected with the second pairing setting units through the power line.

In an embodiment of the present disclosure, the third pairing setting unit comprises a third power line communication unit and a third controller in electrical connection with the third power line communication unit.

The present disclosure provides a power distribution system that is applicable to supply electrical power to a plurality of lighting units and that comprises at least one user interface, which comprises a first wireless pairing setting unit, a plurality of second wireless pairing setting units, and a power line, which is electrically connected with each of the lighting units. The user interface is electrically connected with a power source. Each of the second wireless pairing setting units is electrically connected with one of the lighting units. Each of the second wireless pairing setting units receives a first wireless signal supplied from the first wireless pairing setting unit and, based on the first wireless signal, determines whether to turn on the one of the lighting units associated therewith, whereby the lighting units can be controlled individually.

In an embodiment of the present disclosure, each of the lighting units comprises at least one light source module.

In an embodiment of the present disclosure, each of the second wireless pairing setting units is combined with one of the lighting units.

In an embodiment of the present disclosure, the first wireless pairing setting unit comprises a first wireless communication unit and a first controller in electrical connection with the first wireless communication unit and each of the second wireless pairing setting units comprises a second wireless communication unit and a second controller in electrical connection with the second wireless communication unit, wherein the first controller is applicable to set a signal transmission mode of the first wireless communication unit, and the second controller is applicable to set a signal receipt mode of the second wireless communication unit.

In an embodiment of the present disclosure, the user interface comprises a remote control.

In an embodiment of the present disclosure, the power distribution system further comprises a central control unit, which comprises a third wireless pairing setting unit. Each of the second wireless pairing setting units receives a second wireless signal supplied from the third wireless pairing setting unit and, based on the second wireless signal, determines whether to turn on the one of the lighting units associated therewith, whereby the lighting units are controllable individually.

In an embodiment of the present disclosure, the third pairing setting unit comprises a third wireless communication unit and a third controller in electrical connection with the third wireless communication unit.

Since the present disclosure adopts pairing setting units to set up a power distribution system, the power distribution system according to the present disclosure allows reduction of working hours in the setup operation. Further, the power distribution system of the present disclosure allows for resetting up or modifying the setting of the power distribution system through the use of the pairing setting units without making any change to hardware.

BRIEF DESCRIPTION OF THE DRAWINGS

The present disclosure will be apparent to those skilled in the art by reading the following description of preferred embodiments of the present disclosure, with reference to the attached drawings, in which.

DETAILED DESCRIPTION OF THE PREFERRED EMBODIMENTS

Figure 1:
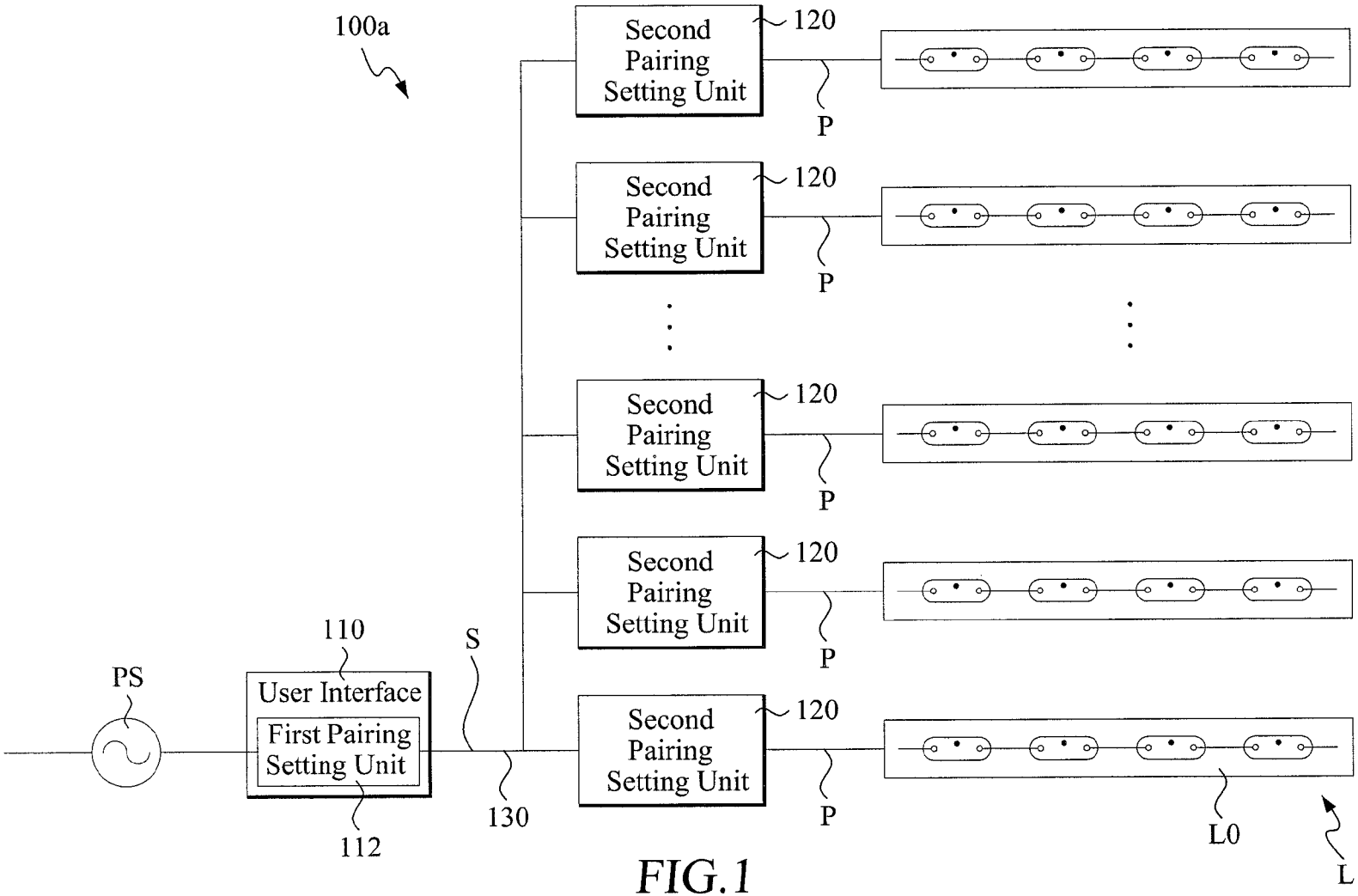
FIG. 1 is a schematic view of a power distribution system according to a first embodiment of the present disclosure.

With reference to the drawings and in particular to FIG. 1, a schematic view of a power distribution system according to a first embodiment of the present disclosure is shown, the power distribution system according to the first embodiment, generally designated at 100*a*, is applicable to supply electrical power P to a plurality of lighting units L. The power distribution system 100*a* comprises at least one user interface 110 having a first pairing setting unit 112, a plurality of second pairing setting units 120, and a power line 130. The user interface 110 is electrically connected with a power source PS (such as an electric main or a solar cell). Each of the second pairing setting units 120 is electrically connected with one of the lighting units L, respectively. The power line 130 is electrically connected between the first pairing setting unit 112 and the second pairing setting units 120. Each of the second pairing setting units 120 receives an electrical signal S output by the first pairing setting unit 112 and, based on the electrical signal S, determines whether to turn on the lighting unit L controlled thereby or not, whereby each of the lighting units L electrically connected to the power line 130 can be individually controlled.

The power distribution system 100*a* of the instant embodiment is applicable to regular residence environment or office buildings. Generally speaking, the user interface 110 used is mostly a switch (such as an interruption switch, a touch switch, and a rotary knob switch). It is understood that the user interface of the instant embodiment is a control platform that enables a user to carry out initial setting and controls activation or de-activation of lighting unit(s).

It is noted that any electronic device that is capable of inter-communication and is programmable can be used as the first pairing setting unit 112 and the second pairing setting units 120 of the instant embodiment. Through communication between the first pairing setting unit 112 and each of the second pairing setting units 120, a constructor or a user may easily carry out setting of the whole power distribution system 100*a* through the performance of initial setting. Details of the first pairing setting unit 112 and the second pairing setting units 120 will be described hereinafter with reference to FIG. 2.

In the instant embodiment, the lighting units L used can be any type of lighting device. In the instant embodiment, each lighting unit L is formed of a single light source module L0. In other words, each second pairing setting unit 120 controls the activation or de-activation of a light source module L0 according to a corresponding electrical signal S. Further, the lighting unit L can be formed of for example multiple lighting tubes, lighting bulbs, or light sources of other types.

The power distribution system 100*a* of the instant embodiment can be easily set up and a constructor only needs to identify the location of each lighting unit L connected with the power line 130 and then extends the power line 130 to the location of each lighting unit L. The constructor does not need to recognize the style of connection between each lighting unit L and the user interface 110. As apparent from FIG. 1, the constructor only needs to connect the user interface 110 to a signal input terminal of the power line 130 and connect signal output terminals of the power line 130 to the second pairing setting units 120 respectively to complete the setup of the power line 130.

Once the setup of the power line 130 is completed, the constructor carries out initial setting through the user interface 110 in order to enable the first pairing setting unit 112 to supply various electrical signals S and enable each of the second pairing setting units 120 to receive and identify all sorts of electrical signals S supplied from the first pairing setting unit 112. In other words, performance of initial setting enables the user interface 110 to individually control the lighting units L.

As can be seen in FIG. 1, once the initial setting of the power distribution system 100*a* is done, when a user attempts to control the activation or de-activation of the lighting units L, the electrical signal S supplied from the user interface 110 is transmitted through the power line 130 to all the second pairing setting units 120 and each second pairing setting unit 120 operates according to the received electrical signal S to activate or de-activate the respective lighting unit L controlled thereby.

It is noted that the user interface 110 of the instant embodiment does not need multiple individual power lines to respectively and electrically connect with the lighting units L. Thus, the instant embodiment can effectively reduce the rate of incorrect arrangement of power lines.

Figure 2:
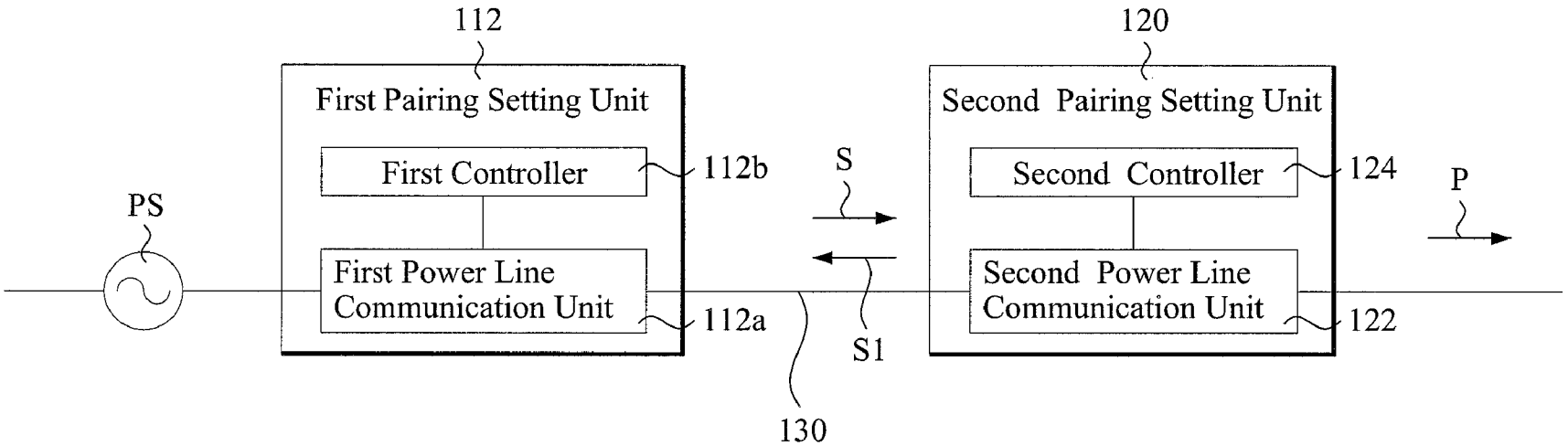
FIG. 2 a schematic view showing the interconnection between a first pairing setting unit and a second pairing setting unit illustrated in FIG. 1.

FIG. 2 is a schematic view showing the interconnection between the first pairing setting unit and one of the second pairing setting units illustrated in FIG. 1. As shown in FIG. 2, the first pairing setting unit 112 of the instant embodiment comprises a first power line communication unit 112*a* and a first controller 112*b* in electrical connection with the first power line communication unit 112*a*. Each of the second pairing setting units 120 comprises a second power line communication unit 122 and a second controller 124 in electrical connection with the second power line communication unit 122. The first controller 112*b* functions to set a signal transmission mode of the first power line communication unit 112*a*, while the second controller 124 sets a signal receipt mode of the second power line communication unit 122.

Figure 3:
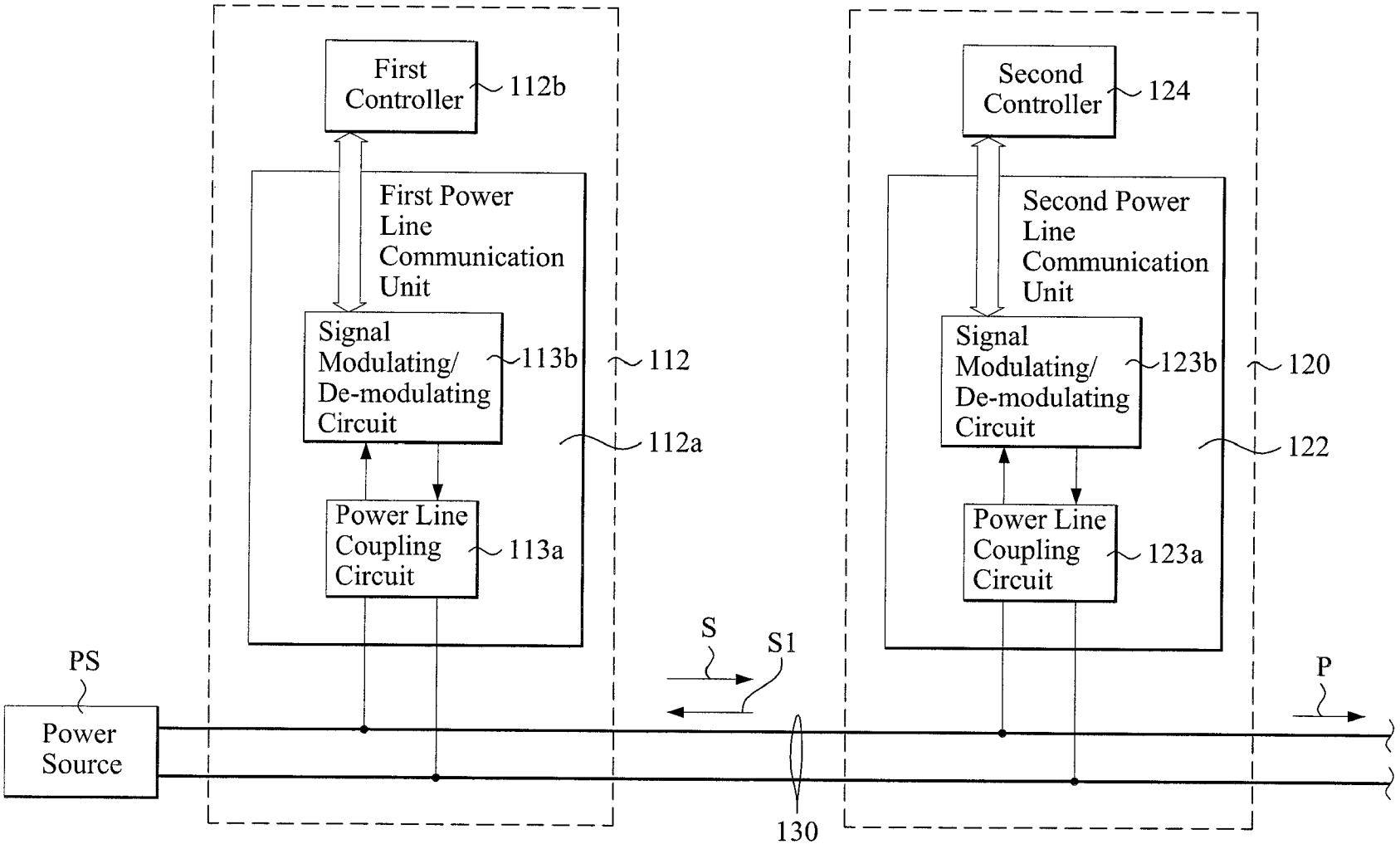
FIG. 3 is a circuit function block diagram of the first pairing setting unit and the second pairing setting unit illustrated in FIG. 2.

FIG. 3 shows a circuit function block diagram of the first pairing setting unit 112 and the second pairing setting unit 120 illustrated in FIG. 2. As shown, the first power line communication unit 112*a* of the first pairing setting unit 112 comprises a power line coupling circuit 113*a* and a signal modulating/de-modulating circuit 113*b*. The signal modulating/de-modulating circuit 113*b* is connected through a data transmission interface (not shown) to the first controller 112*b*, while the power line coupling circuit 113*a* is connected between the power line 130 of the power source PS and the signal modulating/de-modulating circuit 113*b*. The signal modulating/de-modulating circuit 113*b* performs modulation/de-modulation of a signal transmitted from the first controller 112*b* and the modulated/de-modulated signal is applied through the power line coupling circuit 113*a* to the power line 130.

The second power line communication unit 122 of the second pairing setting unit 120 comprises a power line coupling circuit 123*a* and a signal modulating/de-modulating circuit 123*b*. The signal modulating/de-modulating circuit 123*b* is connected through a data transmission interface (not shown) to the second controller 124, while the power line coupling circuit 123*a* is connected between the power line 130 of the power source PS and the signal modulating/de-modulating circuit 123*b*. The signal modulating/de-modulating circuit 123*b* performs modulation/de-modulation of a signal transmitted from the second controller 124. The modulated/de-modulated signal is applied through the power line coupling circuit 123*a* to the power line 130.

It is noted that the first controller 112*b* and the second controller 124 can be a manually-operated mode-switchable switch, an electric programmable switch, or switches of other types.

The first pairing setting unit 112 and the second pairing setting units 120 of the instant embodiment can perform communication therebetween that is bi-directional. In other words, the second pairing setting unit 120 may also supply (feed back) an electrical feedback signal S1 to the first pairing setting unit 112. For example, to allow for supply (feedback) of an electrical signal from the second pairing setting unit 120 to the first pairing setting unit 112, the second controller 124 may comprise a microprocessor or a sensor.

In case that the second controller 124 comprises a microprocessor, the second controller 124 (the microprocessor) may compute electrical loading of a respective lighting unit L in order to determine whether the light source (such as a lighting tube or lighting bulb) of the lighting unit L is turned on or not. Specifically, when the light source is broken, the second controller 124 (the microprocessor) detects a reduction of electrical loading of the lighting unit L and, under this condition, the second controller 124 (the microprocessor) supplies (feeds) an electrical signal back to the first pairing setting unit 112, so that the user can get a message indicating the light source is broken and replacement can be carried out.

In case the second controller 124 comprises a sensor, the second controller 124 (the sensor) that detects if a person or an object is entering a detection range thereof and supplies (feed) an electrical signal back to the first pairing setting unit 112, in order to activate a respective lighting unit L or to notify the user of a message indicating a person or an object is entering the detection range of the second controller 124 (the sensor).

Figure 4:
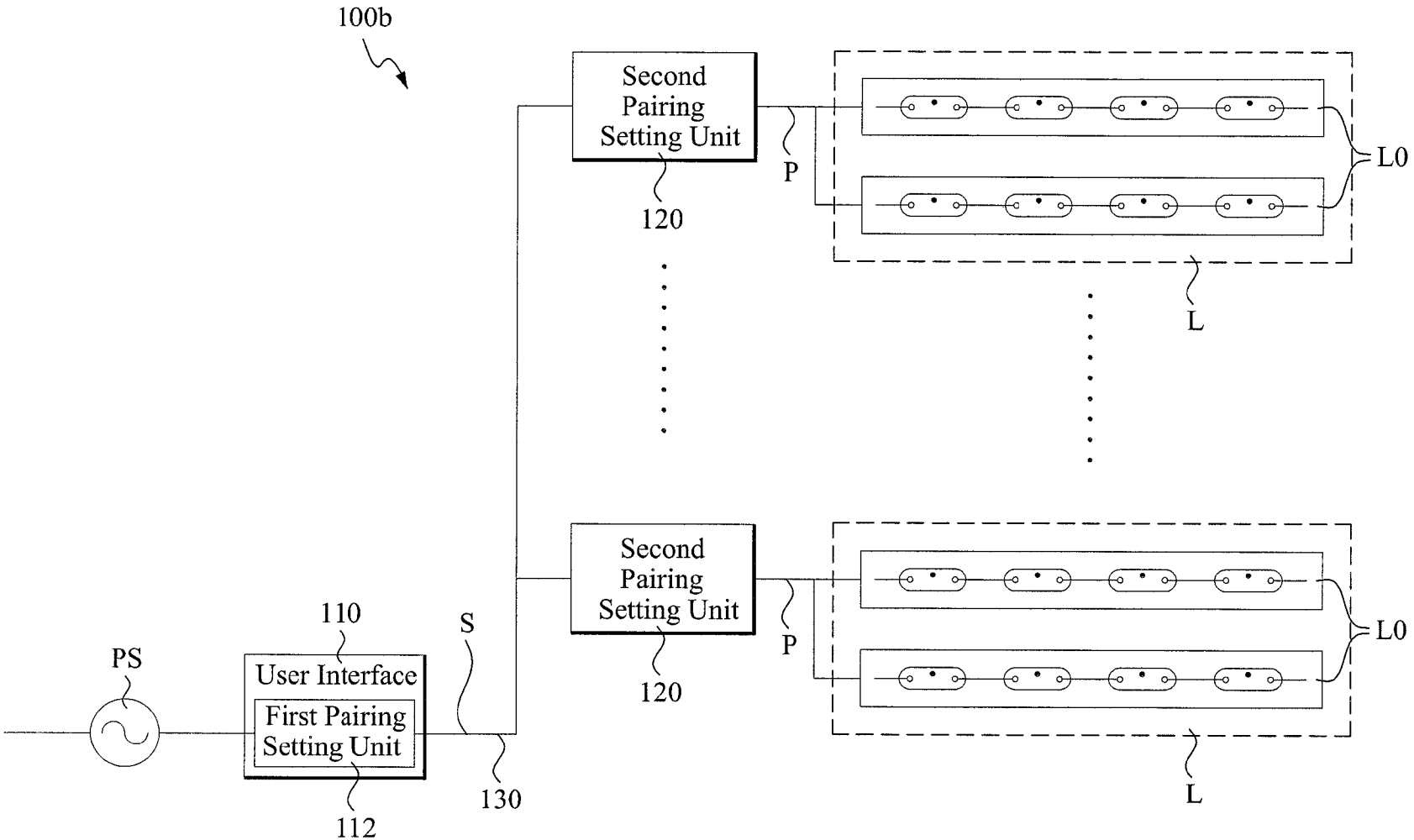
FIG. 4 is a schematic view of a power distribution system according to a second embodiment of the present disclosure.

FIG. 4 is a schematic view of a power distribution system according to a second embodiment of the present disclosure. Reference is now made to FIGS. 2-4, the power distribution system according to the second embodiment, which is generally designated at 100*b*, is similar to the power distribution system 100*a* of the first embodiment, but a difference resides between the two embodiments in that the power distribution system 100*b* of the second embodiment comprises a plurality of lighting units L each of which is composed of multiple light source modules L0. Each of a plurality of second pairing setting units 120 functions to simultaneously control activation and de-activation of the multiple light source modules L0 associated therewith.

Figure 5:
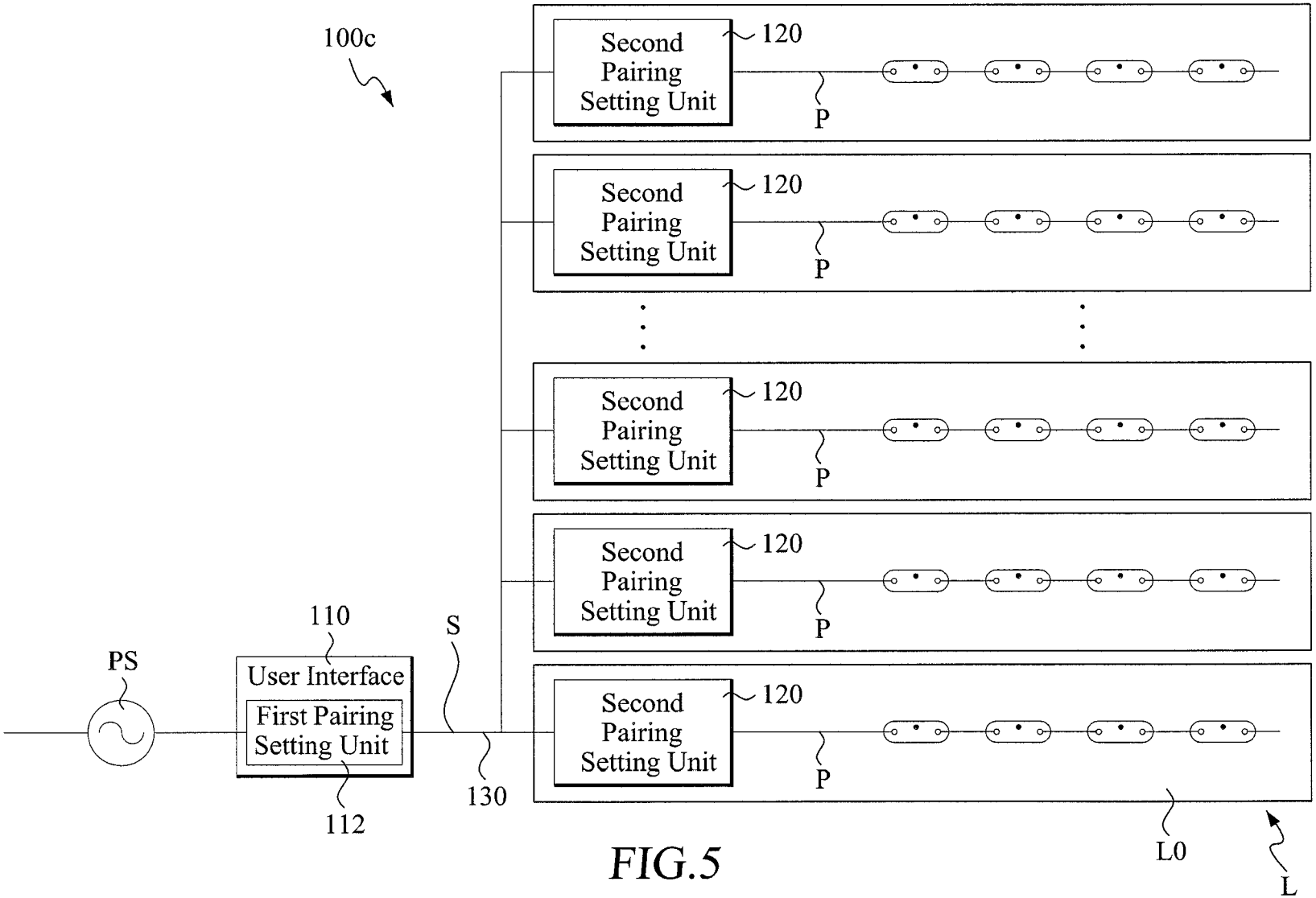
FIG. 5 is a schematic view of a power distribution system according to a third embodiment of the present disclosure.

FIG. 5 is a schematic view of a power distribution system according to a third embodiment of the present disclosure. Reference is also made to FIGS. 2-4, the power distribution system according to the third embodiment, which is generally designated at 100*c*, is similar to the power distribution system 100*a* of the first embodiment, but a difference resides between the two embodiments in that the power distribution system 100*c* of the third embodiment comprises second pairing setting units 120, which are respectively integrated with corresponding lighting units L.

Figure 6:
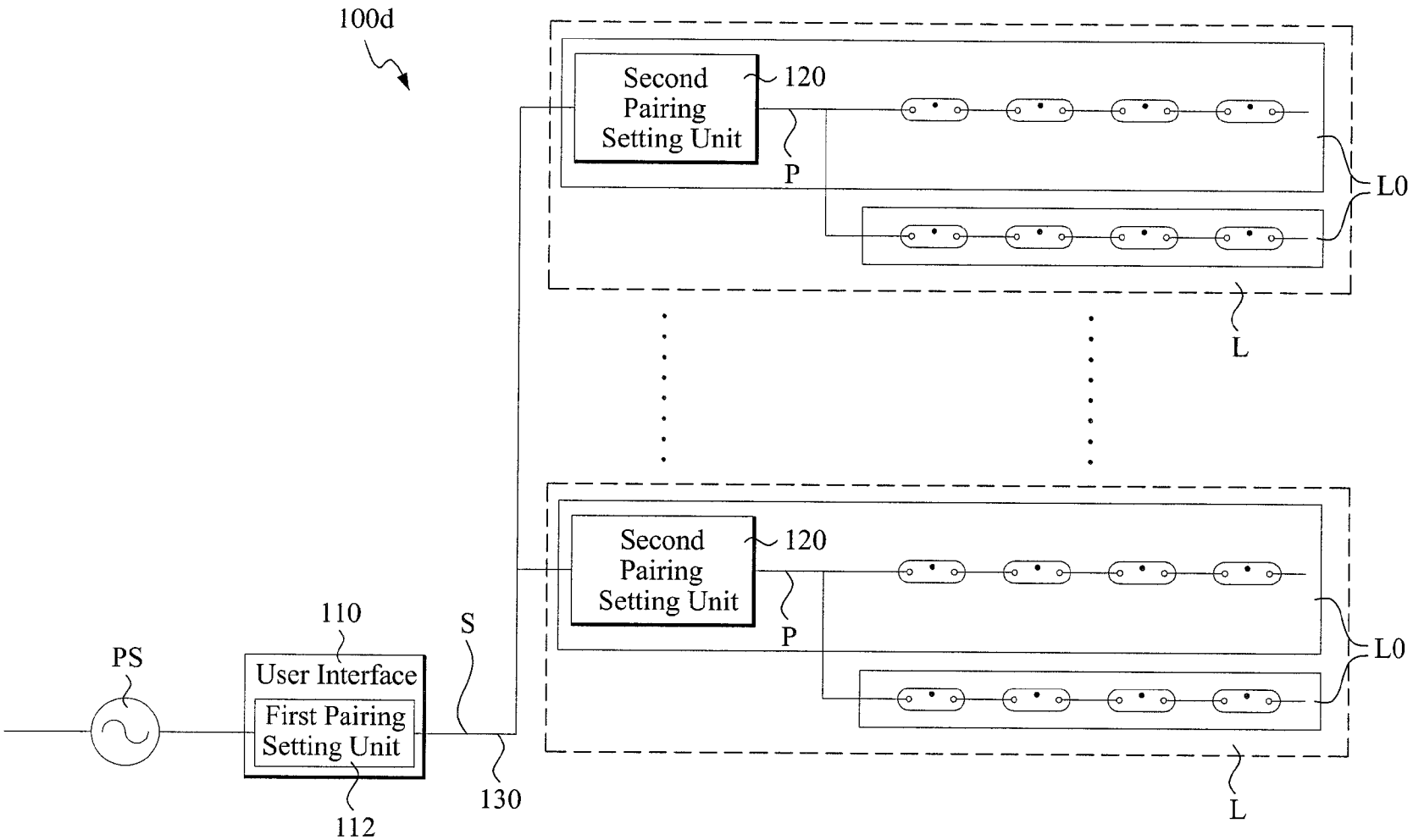
FIG. 6 is a schematic view of a power distribution system according to a fourth embodiment of the present disclosure.

FIG. 6 is a schematic view of a power distribution system according to a fourth embodiment of the present disclosure. Reference is now made to FIGS. 5 and 6, the power distribution system according to the fourth embodiment, which is generally designated at 100*d*, is similar to the power distribution system 100*a* of the first embodiment, but a difference resides between the two embodiments in that the power distribution system 100*d* of the fourth embodiment comprises a plurality of lighting units L each of which is composed of multiple light source modules L0 and a plurality of second pairing setting units 120 each of which functions to simultaneously control activation and de-activation of the multiple light source modules L0 of the lighting unit L associated therewith.

Figure 7:
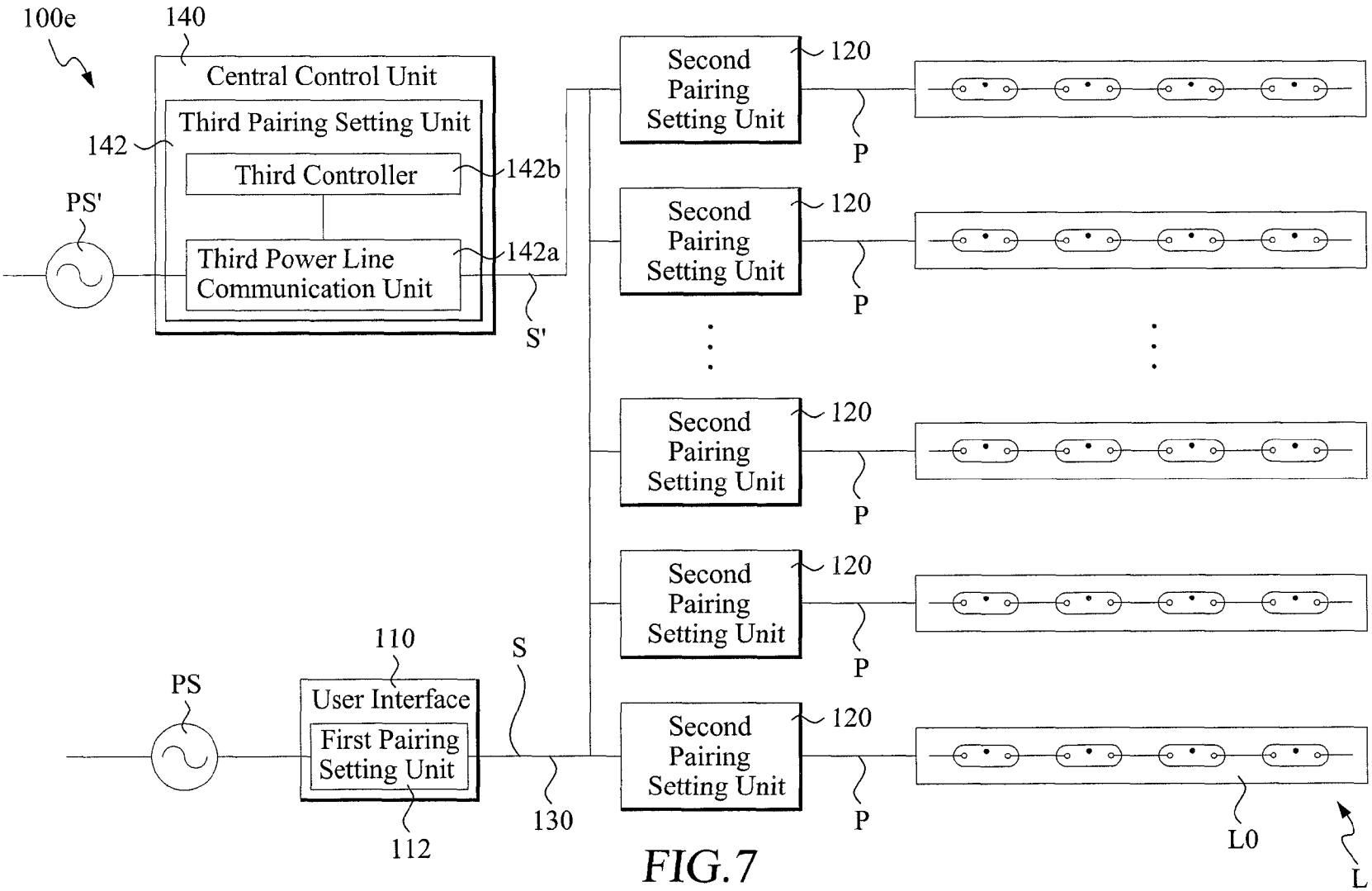
FIG. 7 is a schematic view of a power distribution system according to a fifth embodiment of the present disclosure.

FIG. 7 is a schematic view of a power distribution system according to a fifth embodiment of the present disclosure. As shown in FIG. 7, the power distribution system according to the fifth embodiment, which is generally designated at 100*e*, is similar to the power distribution system 100*a* of the first embodiment, but a difference resides between the two embodiments in that the power distribution system 100*e* of the fifth embodiment comprises a central control unit 140 in electrical connection with the power line 130. As shown in FIG. 7, the central control unit 140 comprises a third pairing setting unit 142, which is electrically connected with a plurality of second pairing setting units 120 through a power line 130. Further, the third pairing setting unit 142 comprises a third power line communication unit 142*a* and a third controller 142*b* in electrical connection with the third power line communication unit 142*a*. The third power line communication unit 142*a* supplies an electrical signal S' that is transmitted through the power line 130 to all the second pairing setting units 120. It is noted that the central control unit 140 that comprises the third pairing setting unit 142 according to the instant embodiment is also applicable to the power distribution systems 100*b*, 100*c*, 100*d* (respectively shown in FIGS. 4-6) according to the second to fourth embodiments.

Initial setting of the third pairing setting unit 142 is similar to those of the first pairing setting unit 112 and the second pairing setting units 120, so that further description in this respect will be omitted.

Figure 8:
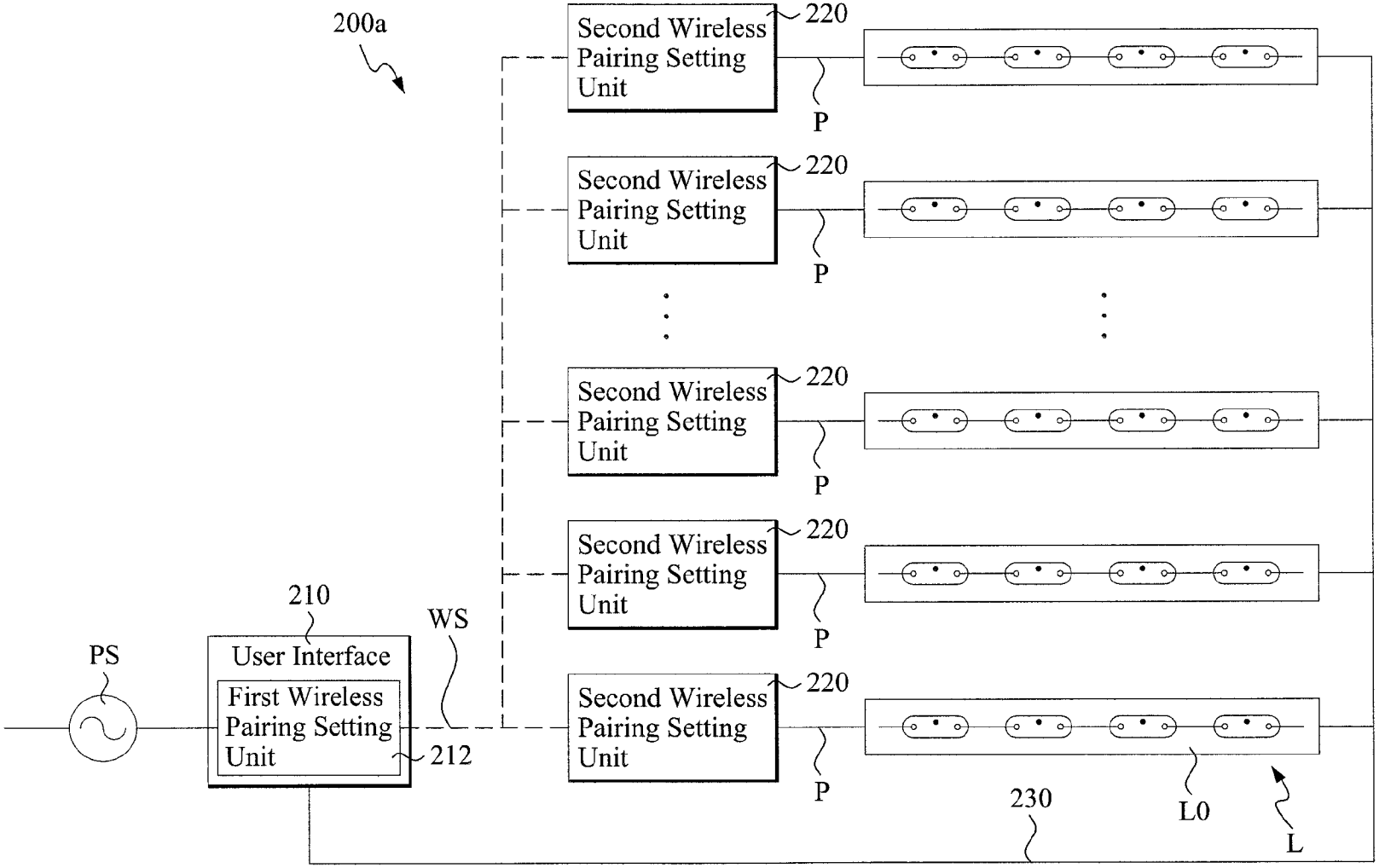
FIG. 8 is a schematic view of a power distribution system according to a sixth embodiment of the present disclosure.

FIG. 8 is a schematic view of a power distribution system according to a sixth embodiment of the present disclosure. As shown in FIG. 8, the power distribution system according to the sixth embodiment, generally designated at 200*a*, is applicable to supply electrical power P to a plurality of lighting units L. The power distribution system 200*a* comprises at least one user interface 210 having a first wireless pairing setting unit 212, a plurality of second wireless pairing setting units 220, and a power line 230 electrically connected with each of the lighting units L. The user interface 210 is electrically connected with a power source PS (such as an electric main or a solar cell). Each of the second wireless pairing setting units 220 is electrically connected with one of the lighting units L, respectively. Each of the second wireless pairing setting units 220 receives a wireless signal WS output by the first wireless pairing setting unit 212 and, based on the wireless signal WS, determines whether to turn on the lighting unit L controlled thereby or not, whereby each of the lighting units L can be individually controlled.

The power distribution system 200*a* of the sixth embodiment is applicable to regular residence environment or office buildings. Generally speaking, the user interface 210 used is mostly a switch (such as an interruption switch, a touch switch, and a rotary knob switch). It is noted that the user interface 210 used in the instant embodiment can be a remote control. It is understood that the user interface of the instant embodiment may also be a control platform that enables a user to carry out initial setting and controls activation or de-activation of lighting unit(s).

It is noted that any electronic device that is capable of inter-communication and is programmable can be used as the first wireless pairing setting unit 212 and the second wireless pairing setting units 220 of the sixth embodiment. Through communication between the first wireless pairing setting unit 212 and each of the second wireless pairing setting units 220, a constructor or a user may easily carry out setting of the whole power distribution system 200*a* through the performance of initial setting. Details of the first wireless pairing setting unit 212 and the second wireless pairing setting units 220 will be described hereinafter with reference to FIG. 9.

In the sixth embodiment, the lighting units L used can be any type of lighting device. In the instant embodiment, each lighting unit L is formed of a single light source module L0. In other words, each second wireless pairing setting unit 220 controls the activation or de-activation of a light source module L0 according to a corresponding wireless signal WS. Further, the lighting unit L can be formed of for example multiple lighting tubes, lighting bulbs, or light sources of other types.

The power distribution system 200*a* of the sixth embodiment can be easily set up and a constructor only needs to identify the location of each lighting unit L connected with the power line 230 and then extends the power line 230 to the location of each lighting unit L. The constructor does not need to recognize the style of connection between each lighting unit L and the user interface 210.

Once the setup of the power line 230 is completed, the constructor carries out initial setting through the user interface 210 in order to enable the first wireless pairing setting unit 212 to supply various wireless signals WS and enable each of the second wireless pairing setting units 220 to receive and identify all sorts of wireless signals WS supplied from the first wireless pairing setting unit 212. In other words, performance of initial setting enables the user interface 210 to individually control the lighting units L.

It is noted that the user interface 210 of the sixth embodiment can individually communicate with multiple lighting units L through wireless transmission. Thus, the instant embodiment can effectively reduce the amount of power cable used and the rate of incorrect arrangement of power lines.

Figure 9:
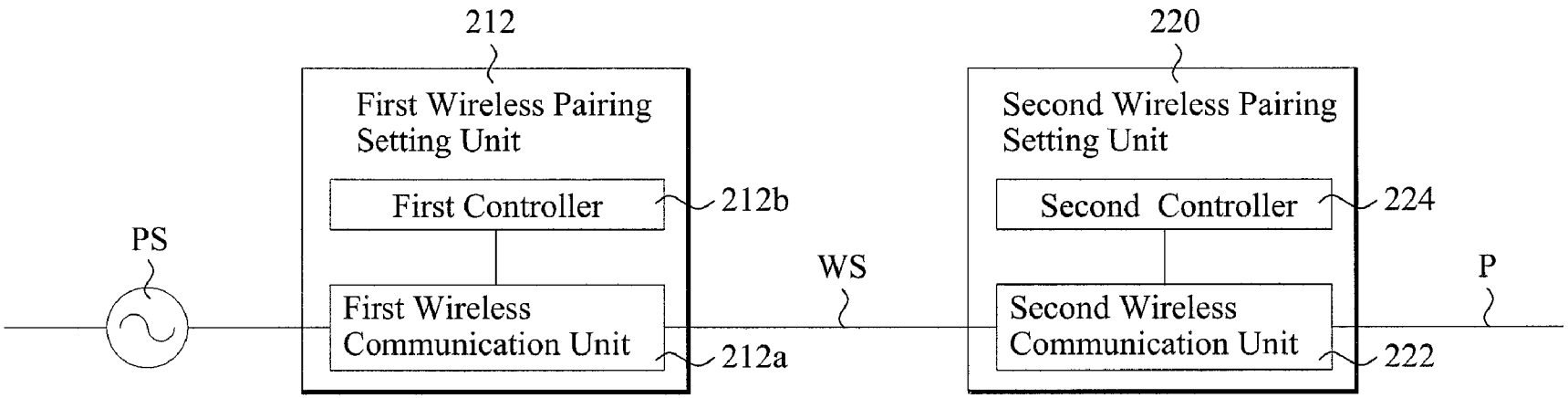
FIG. 9 is a schematic view showing the interconnection between a first wireless pairing setting unit and a second pairing setting unit illustrated in FIG. 8.

FIG. 9 is a schematic view showing the interconnection between the first wireless pairing setting unit and the second pairing setting unit illustrated in FIG. 8. As shown in FIG. 9, the first wireless pairing setting unit 212 of the instant embodiment comprises a first wireless communication unit 212*a* and a first controller 212*b* in electrical connection with the first wireless communication unit 212*a*. Each of the second wireless pairing setting units 220 comprises a second wireless communication unit 222 and a second controller 224 in electrical connection with the second wireless communication unit 222. The first controller 212*b* functions to set a signal transmission mode of the first wireless communication unit 212*a*, while the second controller 224 sets a signal receipt mode of the second wireless communication unit 222.

It is noted that the first controller 212*b* and the second controller 224 can be a manually-operated mode-switchable switch, an electric programmable switch, or switches of other types.

Figure 10:
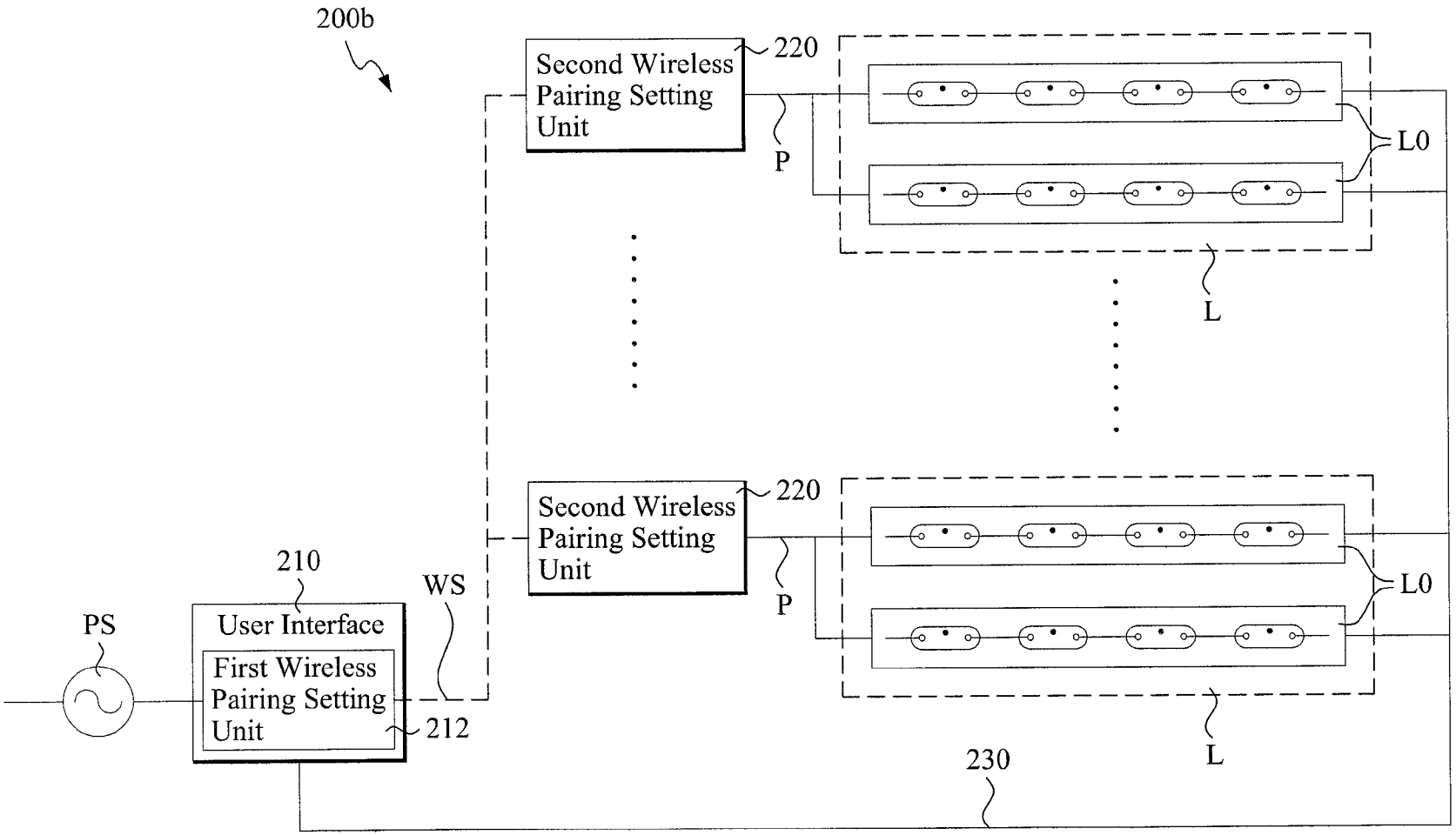
FIGS. 10-12 are schematic views respectively showing power distribution systems according to modified embodiments of the present disclosure.
Figure 11:
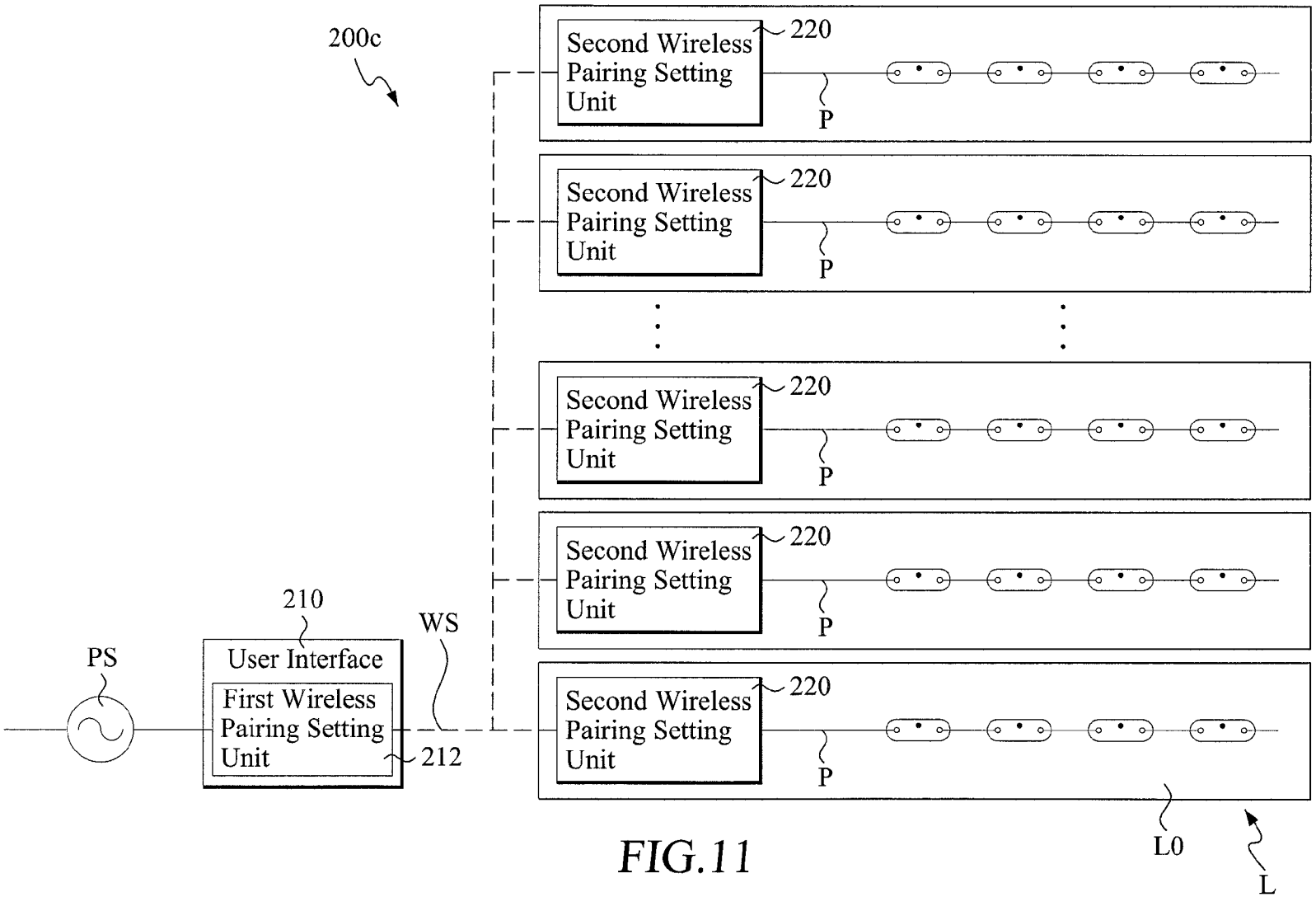
Figure 12:
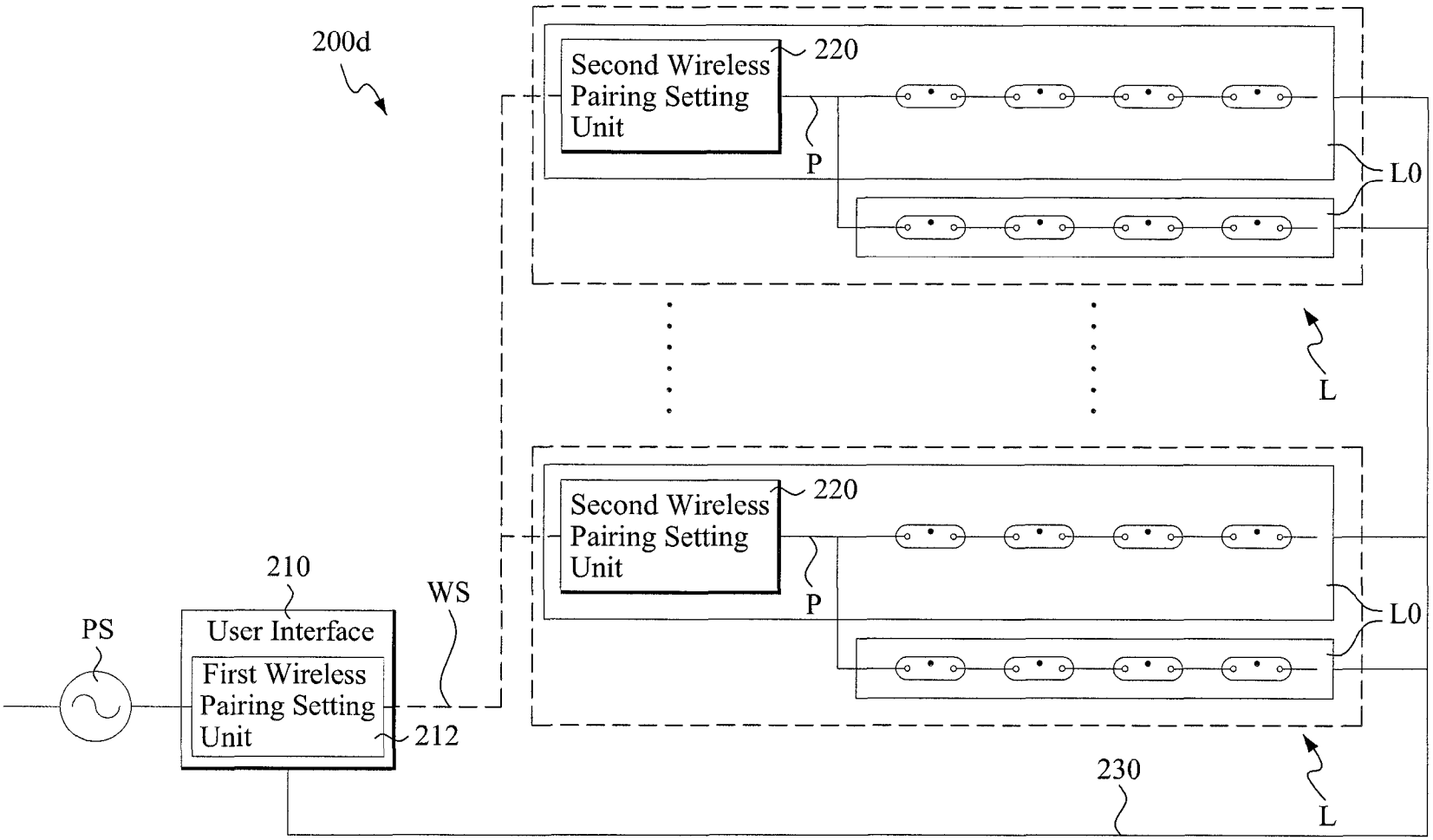

It is noted from the above description that a difference resides between the sixth embodiment and the first embodiment in that the communication between the first wireless pairing setting unit 212 and each of the second wireless pairing setting units 220 is changed from a cabled fashion (power line 130) of the first embodiment to a wireless manner. It is apparent that arrangement described in the instant embodiment is also applicable to the second to fourth embodiments discussed above to form modified embodiments of power distribution systems that are respectively designated at 200*b*, 200*c*, 200*d* in FIGS. 10-12.

Figure 13:
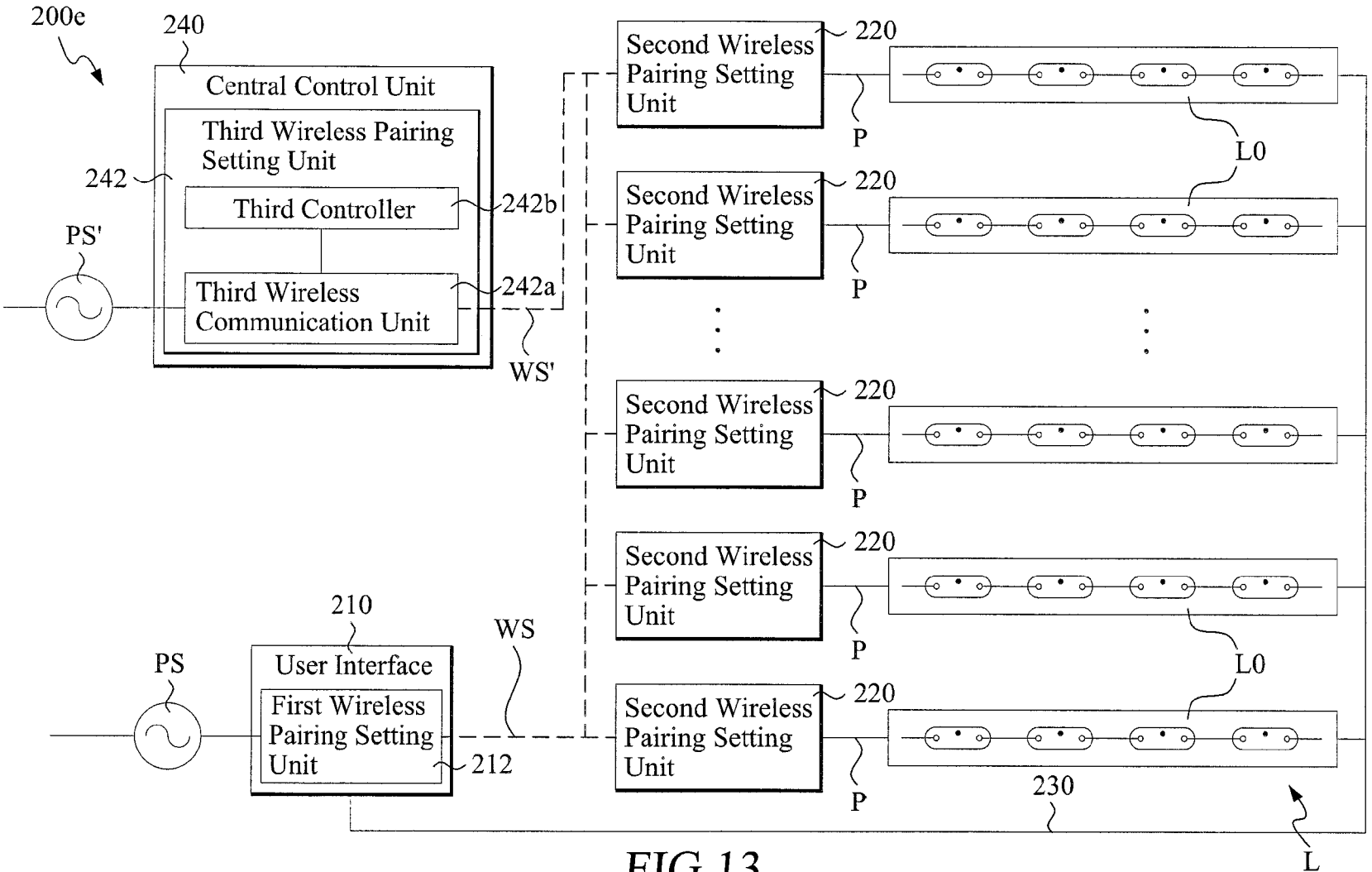
FIG. 13 is a schematic view of a power distribution system according to a seventh embodiment of the present disclosure.

FIG. 13 is a schematic view of a power distribution system according to a seventh embodiment of the present disclosure. As shown in FIG. 13, the power distribution system according to the seventh embodiment, which is generally designated at 200*e*, is similar to the power distribution system 200*a* of the sixth embodiment, but a difference resides between the two embodiments in that the power distribution system 200*e* of the seventh embodiment comprises a central control unit 240. As shown in FIG. 13, the central control unit 240 comprises a third wireless pairing setting unit 242, and each of a plurality of second wireless pairing setting units 220 receives a second wireless signal WS' supplied from the third wireless pairing setting unit 242 to determine whether to turn on a lighting unit L controlled thereby according to the second wireless signal WS', whereby a plurality of lighting units L can be individually controlled.

In summary, the power distribution system according to the present disclosure is advantageous in being easy to set up, reduced rate of incorrect setup, low setup cost, and reduced setup working hour. Further, the power distribution system according to the present disclosure has a high flexibility in electrical re-set up than the existing power distribution systems, making it suit the need of market.

Although the present disclosure has been described with reference to the preferred embodiments thereof, it is apparent to those skilled in the art that a variety of modifications and changes may be made without departing from the scope of the present disclosure which is intended to be defined by the appended claims.

What is claimed is:

1. A power distribution system for supplying electrical power to a plurality of lighting units, the power distribution system comprising:

at least one user interface connecting with a power source and comprising a first pairing setting unit, wherein the first pairing setting unit comprises a first power line communication unit and a first controller in electrical connection with the first power line communication unit;

a plurality of second pairing setting units, each of the plurality of second pairing setting units electrically connected with one of the lighting units, wherein each of the second pairing setting units comprises a second power line communication unit and a second controller in electrical connection with the second power line communication unit; and a power line, electrically connected with each of the lighting units and electrically connected between the first pairing setting unit and the second pairing setting units, wherein each of the second pairing setting units receives an electrical signal supplied from the first pairing setting unit and, based on the electrical signal, determines whether to turn on the one of the lighting units associated therewith, whereby the lighting units in electrical connection with the power line are controllable individually.

2. The power distribution system as claimed in claim 1, wherein each of the lighting units comprises at least one light source module.

3. The power distribution system as claimed in claim 1, wherein each of the second pairing setting units is combined with one of the lighting units.

4. The power distribution system as claimed in claim 1, wherein the user interface comprises a switch.

5. The power distribution system as claimed in claim 1, wherein the first controller is applicable to set a signal transmission mode of the first power line communication unit and the second controller is applicable to set a signal receipt mode of the second power line communication unit.

6. The power distribution system as claimed in claim 5, wherein the first power line communication unit comprises a power line coupling circuit and a signal modulating/de-modulating circuit, the signal modulating/de-modulating circuit being connected to the first controller, the power line coupling circuit being connected between the power source and the signal modulating/de-modulating circuit.

7. The power distribution system as claimed in claim 1, further comprising a central control unit in electrical connection with the power line, the central control unit comprising a third pairing setting unit, which is electrically connected with the second pairing setting units through the power line.

8. The power distribution system as claimed in claim 7, wherein the third pairing setting unit comprises a third power line communication unit and a third controller in electrical connection with the third power line communication unit.

9. A power distribution system adapted to supply electrical power to a plurality of lighting units, the power distribution system comprising:

at least one user interface connecting with a power source and comprising a first pairing setting unit, wherein the first wireless airing setting unit comprises a first wireless communication unit and a first controller in electrical connection with the first wireless communication unit;

a plurality of second wireless pairing setting units, each of is the plurality of second wireless pairing setting units electrically connected with one of the lighting units, wherein each of the second wireless pairing setting units receives a first wireless signal supplied from the first wireless pairing setting unit and, based on the first wireless signal, determines whether to turn on the one of the lighting units associated therewith, whereby the lighting units are controllable individually, and each of the second wireless pairing setting units comprises a second wireless communication unit and a second controller in electrical connection with the second wireless communication unit; and a power line electrically connected with each of the lighting units.

10. The power distribution system as claimed in claim 9, wherein each of the lighting units comprises at least one light source module.

11. The power distribution system as claimed in claim 9, wherein each of the second wireless pairing setting units is combined with one of the lighting units.

12. The power distribution system as claimed in claim 9, wherein the first controller being applicable to set a signal transmission mode of the first wireless communication unit and the second controller is applicable to set a signal receipt mode of the second wireless communication unit.

13. The power distribution system as claimed in claim 9, wherein the user interface comprises a remote control.

14. The power distribution system as claimed in claim 9 further comprising a central control unit comprising a third wireless pairing setting unit, each of the second wireless pairing setting units receiving a second wireless signal supplied from the third wireless pairing setting unit and, based on the second wireless signal, determining whether to turn on the one of the lighting units associated therewith, whereby the lighting units are controllable individually.

15. The power distribution system as claimed in claim 14, wherein the third pairing setting unit comprises a third wireless communication unit and a third controller in electrical connection with the third wireless communication unit.

* * * * *